US007669336B2

(12) United States Patent
Kawafune

(10) Patent No.: US 7,669,336 B2
(45) Date of Patent: Mar. 2, 2010

(54) RECHARGEABLE ELECTRIC SHAVER

(75) Inventor: Kyoichi Kawafune, Matsumoto (JP)

(73) Assignee: Izumi Products Company, Nagano (JP)

( * ) Notice: Subject to any disclaimer, the term of this patent is extended or adjusted under 35 U.S.C. 154(b) by 239 days.

(21) Appl. No.: 10/856,635

(22) Filed: May 27, 2004

(65) Prior Publication Data

US 2004/0237309 A1 Dec. 2, 2004

(30) Foreign Application Priority Data

May 27, 2003 (JP) ..... 2003-149496

(51) Int. Cl.
*B26B 19/14* (2006.01)

(52) U.S. Cl. ..... 30/43.4; 30/45; 30/526; 30/DIG. 1

(58) Field of Classification Search ..... 30/DIG. 1, 30/43.5, 43.6, 43.91, 43.92, 32–84, 526–541
See application file for complete search history.

(56) References Cited

U.S. PATENT DOCUMENTS

| | | | | |
|---|---|---|---|---|
| 2,281,753 | A * | 5/1942 | Dalkowitz | 310/47 |
| 4,835,452 | A | 5/1989 | Kuriyama | |
| 5,283,953 | A * | 2/1994 | Ikuta et al. | 30/43.6 |
| 5,544,415 | A | 8/1996 | Huang | |
| 6,430,813 | B2 * | 8/2002 | Muraguchi et al. | 30/43.92 |
| 6,892,457 | B2 * | 5/2005 | Shiba et al. | 30/43.92 |
| 7,020,965 | B2 * | 4/2006 | Bao | 30/43.6 |
| 2003/0177642 | A1 * | 9/2003 | Bax | 30/43.6 |
| 2004/0007244 | A1 * | 1/2004 | Harms | 132/322 |
| 2008/0294176 | A1 * | 11/2008 | Hashiguchi et al. | 30/43.5 |

FOREIGN PATENT DOCUMENTS

| | | | |
|---|---|---|---|
| EP | 2001009177 | | 1/2001 |
| EP | 1481774 | A1 * | 12/2004 |
| JP | S58-165884 | | 9/1983 |
| JP | 09038353 | A * | 2/1997 |
| WO | WO 03/041918 | A1 * | 5/2003 |

* cited by examiner

*Primary Examiner*—Jason Daniel Prone
(74) *Attorney, Agent, or Firm*—William L. Androlia; H. Henry Koda

(57) ABSTRACT

A rechargeable electric shaver having a partition wall installed inside the main body casing, the partition wall separating a rechargeable battery compartment that accommodates the rechargeable battery and a driving portion compartment that accommodates a motor, and the partition wall having a sealing structure which allows a main body of the motor to protrude into the rechargeable battery compartment and seals the rechargeable battery compartment and driving portion compartment in an airtight manner.

3 Claims, 5 Drawing Sheets

RECHARGEABLE ELECTRIC SHAVER

BACKGROUND OF THE INVENTION

1. Field of the Invention

The present invention relates to a rechargeable electric shaver and more particularly relates to a highly safe rechargeable electric shaver which has waterproof properties.

2. Prior Art

A rechargeable electric shaver is repeatedly used by recharging a rechargeable battery installed inside the main body casing of the shaver. In such a rechargeable electric shaver, there are absolutely no problems in an ordinary recharging operation. However, if reverse charging is performed or if excessive charging is performed as a result of rapid charging, then problems arise. Oxygen gas and hydrogen gas generate inside the rechargeable battery by the charge-discharge reaction. Accordingly, a safety valve which releases gas to the outside of the rechargeable battery when the internal gas pressure rises to an abnormal level is disposed in the rechargeable battery.

However, in the case of a waterproof type electric shaver, the main body casing is formed as a structure that is sealed off from the outside in a watertight manner in order to waterproof various types of parts accommodated in the main body casing. Accordingly, the gas released from the rechargeable battery fills the interior of the main body casing, and a problem of ignition of the hydrogen gas by sparks from the motor has been encountered. Accordingly, in the case of waterproof type rechargeable electric shavers, a ventilation port is formed in the main body casing, and the main body casing is sealed in a watertight manner by closing the ventilation port with a gas-permeable sheet or the like, so that gas released inside the main body casing is discharged to the outside of the main body casing.

However, in such a structure, the discharge of the gas released from the rechargeable battery to the outside of the main body casing is hindered by the gas-permeable sheet, and the problem of ignition of the gas that accumulates inside the main body casing arises. So as to solve this problem, in the rechargeable electric shaver described in Japanese Patent Application Laid-Open (Kokai) No. S58-165884, a rechargeable battery compartment and a driving portion compartment that accommodates the motor are separated in an airtight manner using a sealing member, so that sparks do not ignite the gas.

The structure in which the rechargeable battery compartment that is a gas generation source and the driving portion compartment in which sparks might occurs are separated in an airtight manner as described above is effective in preventing ignition by sparks. However, when a partition wall is installed so that the partition member cuts across the interior of the main body casing in order to separate the rechargeable battery compartment and driving portion compartment in an airtight manner a problem arises. Disposition of parts inside the electric shaver is restricted.

Especially in the case of electric shavers in which its main body casing is in a curved shape, if a partition member is installed so that the partition member cuts across the interior of the main body casing, the degree of freedom with which parts can be installed therein is restricted, and the installation of such parts becomes difficult.

FIG. 2 shows an electric rotary shaver that has a curved main body casing. In this shaver, a cutter head 12 is detachably mounted on the upper portion of a main body casing 10, and outer cutters 14 are provided in this cutter head 12.

FIG. 3 shows the inside the main body casing 10 of the electric shaver of FIG. 2. The reference numeral 16 is a partition member, 18 is a rechargeable battery, and 20 is a motor. The partition member 16 is disposed so that this wall cuts across the main body casing 10, and the rechargeable battery compartment A and the driving portion compartment B in which the motor 20 are separated by the partition member 16.

Since the partition member 16 is installed so that the wall cuts across the interior space of the main body casing 10, the interior space of the main body casing 10 is divided into two by this partition member 16, and parts are installed in the respective spaces that are partitioned from each other by the partition member 16. In cases where a number of parts that are required for the control of the electric shaver are employed, these parts must be separately installed in the spaces that are partitioned from each other by the partition member 16. As a result, electrical connections must be made with the partition member 16 interposed, and a complicated structure in which electrical connections are made in the partition member 16 must be adopted.

SUMMARY OF THE INVENTION

The present invention is to solve the problems encountered in the prior art waterproof type electric shavers.

It is thus an object of the present invention to provide a rechargeable electric shaver in which the danger that hydrogen gas generated by the rechargeable battery will be ignited by sparks from the motor is eliminated, so that the shaver has sufficient safety.

It is another object of the present invention to provide a rechargeable electric shaver in which the internal structure is free of complication, so that the installation of parts, etc. is facilitated, and the assembly is easy.

It is still another object of the present invention to provide a rechargeable electric shaver that is high in the degree of freedom of design.

The above objects are accomplished by a unique structure of the present invention for a rechargeable electric shaver that has a rechargeable battery installed inside the main body casing; and in the present invention:

the shaver is provided with a partition wall inside the main body casing, the partition wall separating a rechargeable battery compartment that accommodates the rechargeable battery and a driving portion compartment that accommodates a motor; and the partition wall is provided with a sealing means, and the sealing means allows a main body of the motor to protrude into the rechargeable battery compartment and seals the rechargeable battery compartment and driving portion compartment in an airtight manner.

In this structure, the partition wall has a motor mounting hole; a motor cover which is a casing with a closed bottom and accommodates the main body of the motor is attached in an airtight manner to the partition wall, the motor cover communicating with the motor mounting hole and the bottom side of the motor cover being caused to protrude into the rechargeable battery compartment; and the main body of the motor is set in the motor cover.

Furthermore, a flange is provided on the circumferential edge of an opening of the motor cover, and a sealing member is provided between the partition wall and the flange, so that airtightness is assured between the motor cover and the partition wall.

The motor cover is made of a synthetic resin.

In addition, in the rechargeable electric shaver of the present invention, the rechargeable battery compartment is provided in the bottom area of the main body casing, and the driving portion compartment is provided adjacent to this rechargeable battery compartment with the partition wall in between, and the driving portion compartment is provided to be sealed in a watertight manner to the cutter cradle on which the cutter head is mounted.

DETAILED DESCRIPTION OF THE INVENTION

Preferred embodiments of the rechargeable electric shaver of the present invention will be described in detail below.

Figure 1:
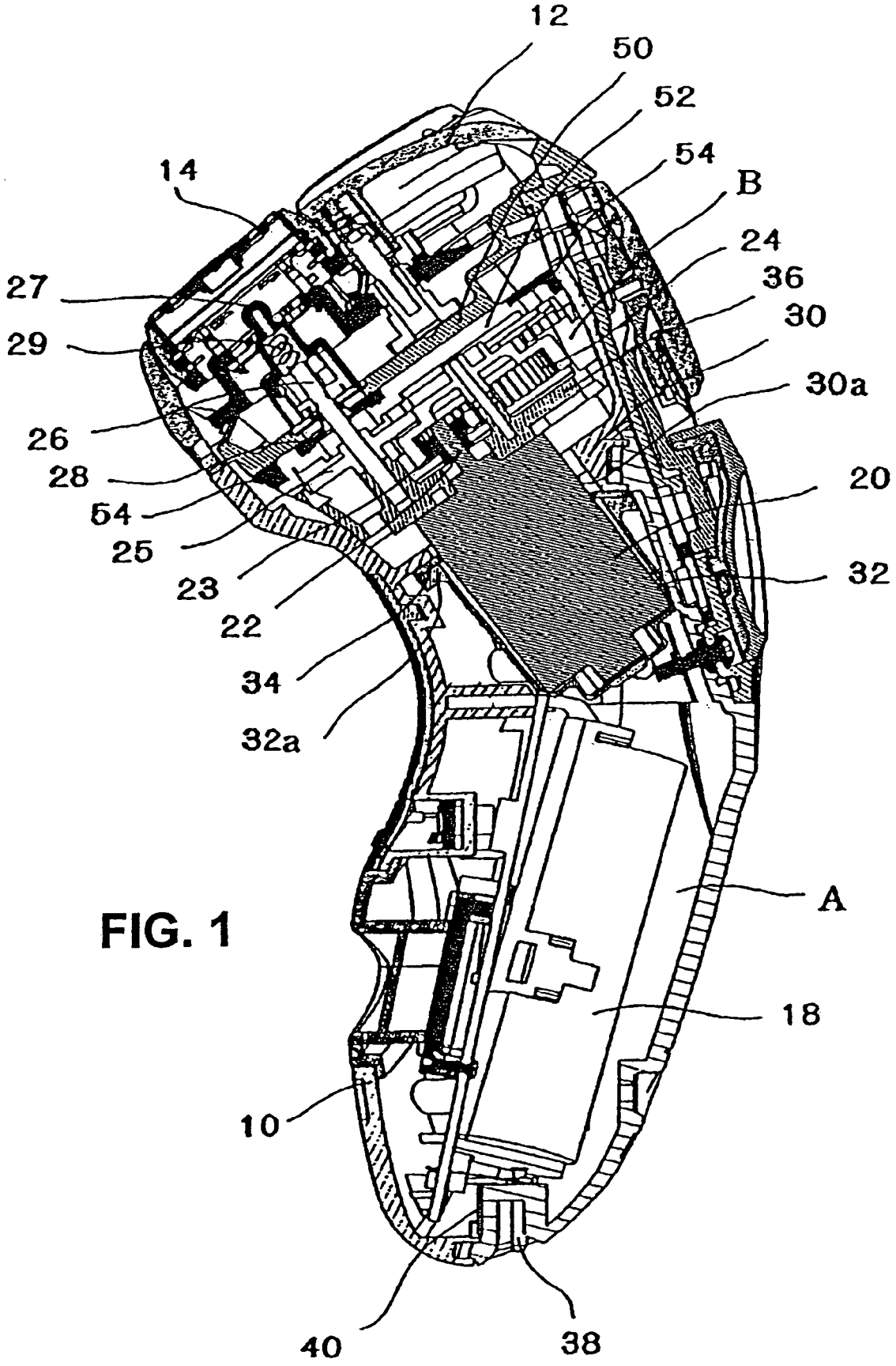
FIG. 1 shows the internal structure of one embodiment of the rechargeable electric shaver of the present invention.
Figure 2:
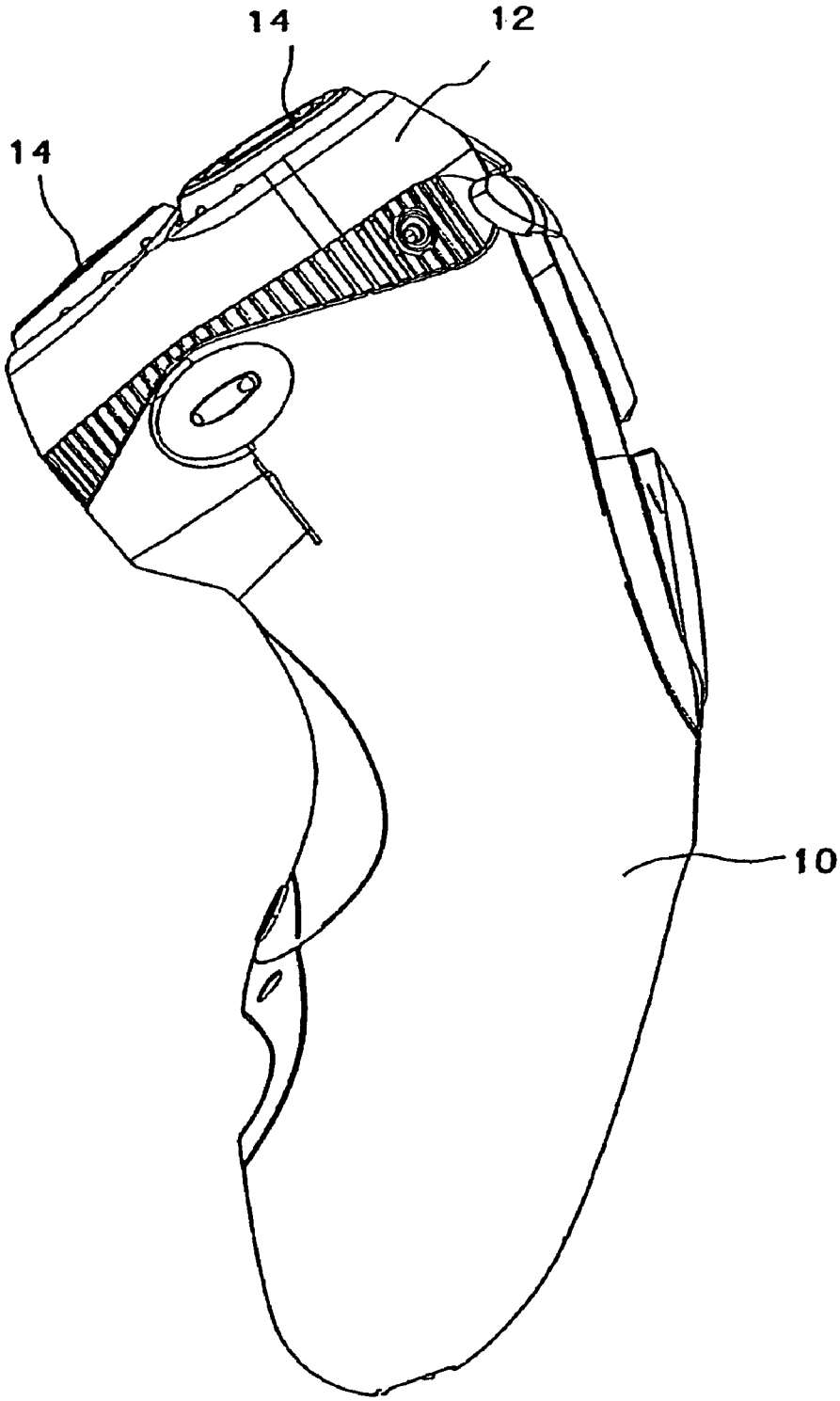
FIG. 2 PRIOR ART
FIG. 2 is a side view of the overall shape of a rechargeable electric shaver of the prior art.
Figure 3:
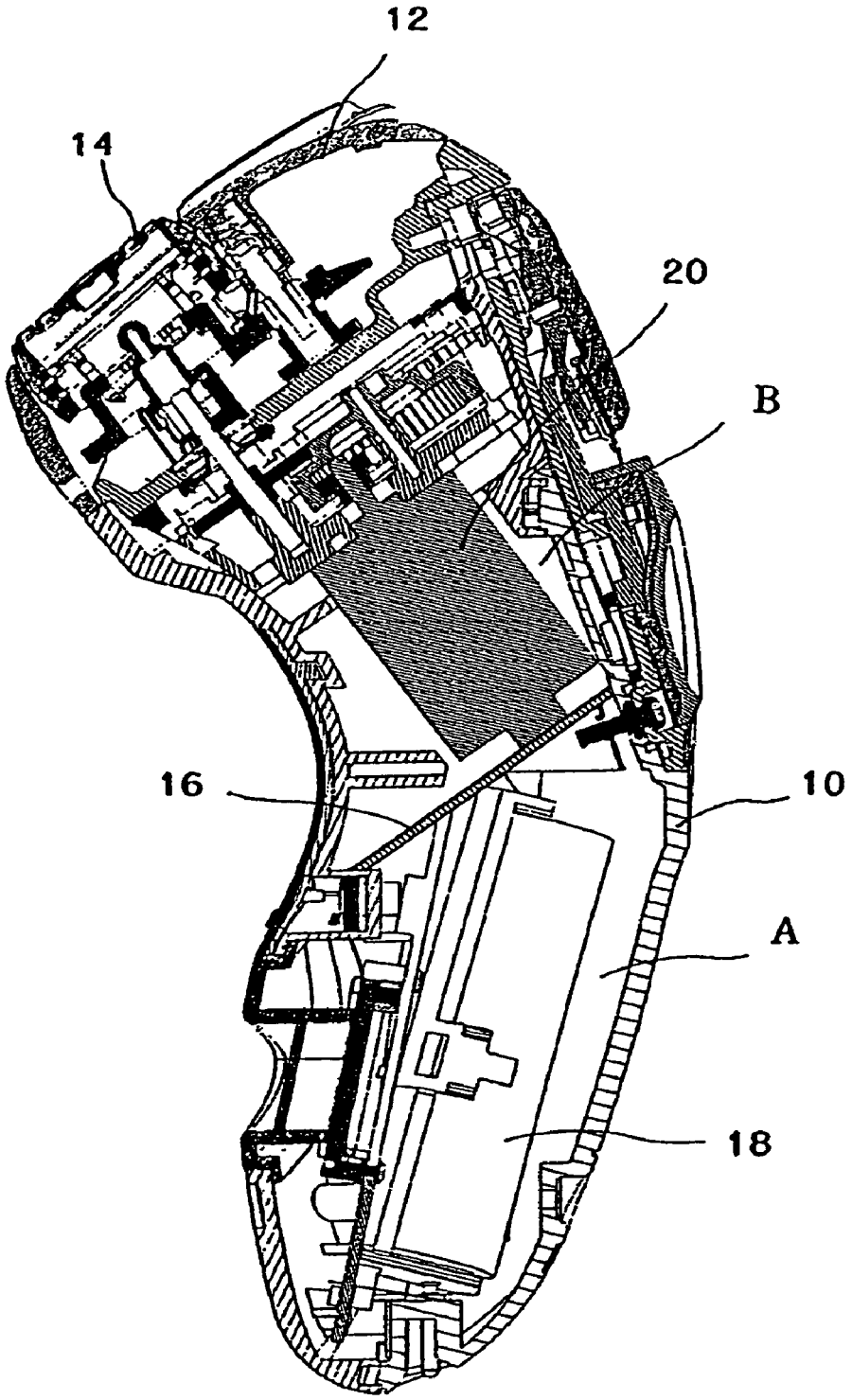
FIG. 3 PRIOR ART
FIG. 3 shows the internal structure of prior art rechargeable electric shaver that has a partition wall inside thereof.
Figure 4:
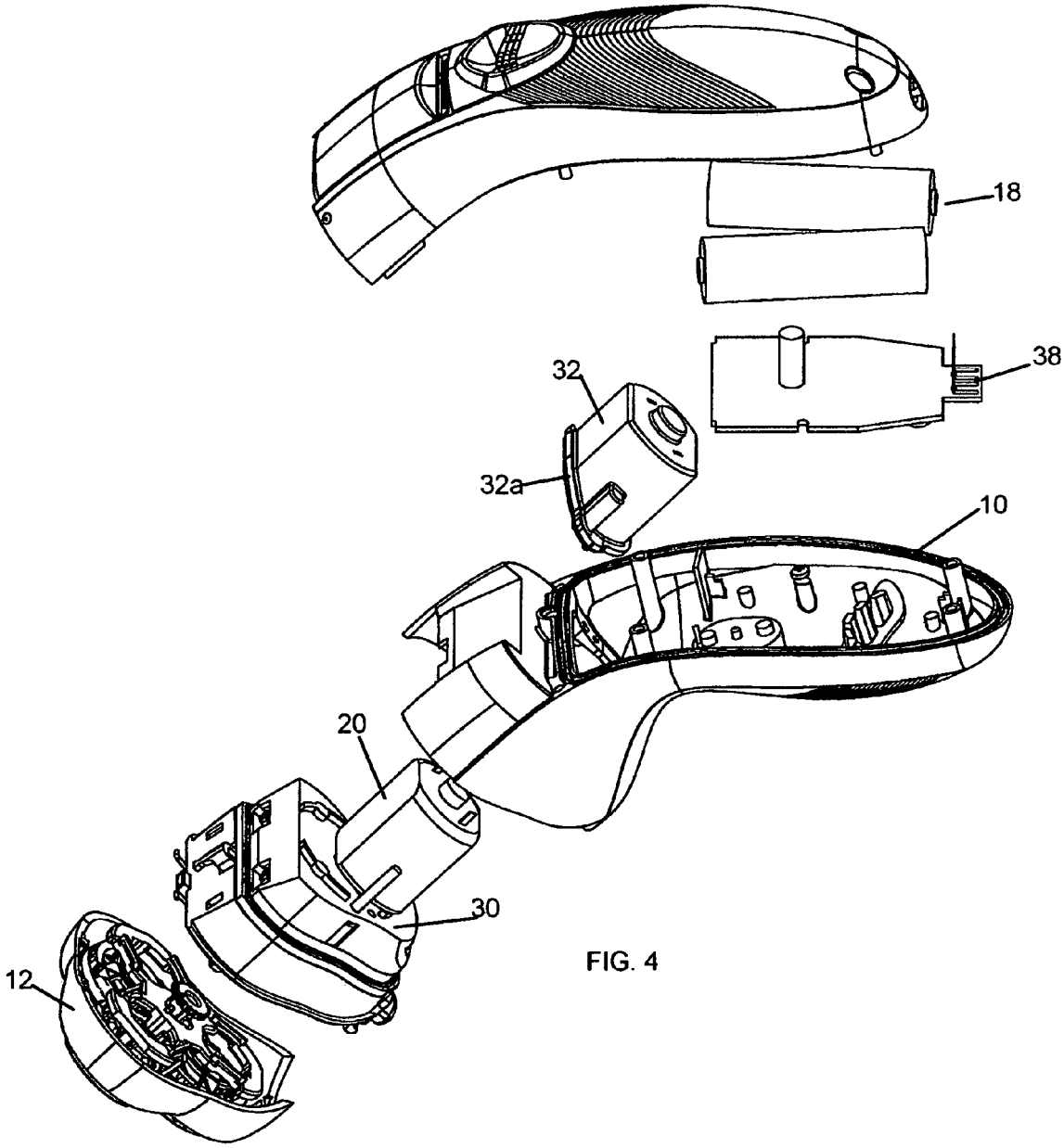
FIG. 4 is an exploded view of the embodiment of FIG. 1.
Figure 5:
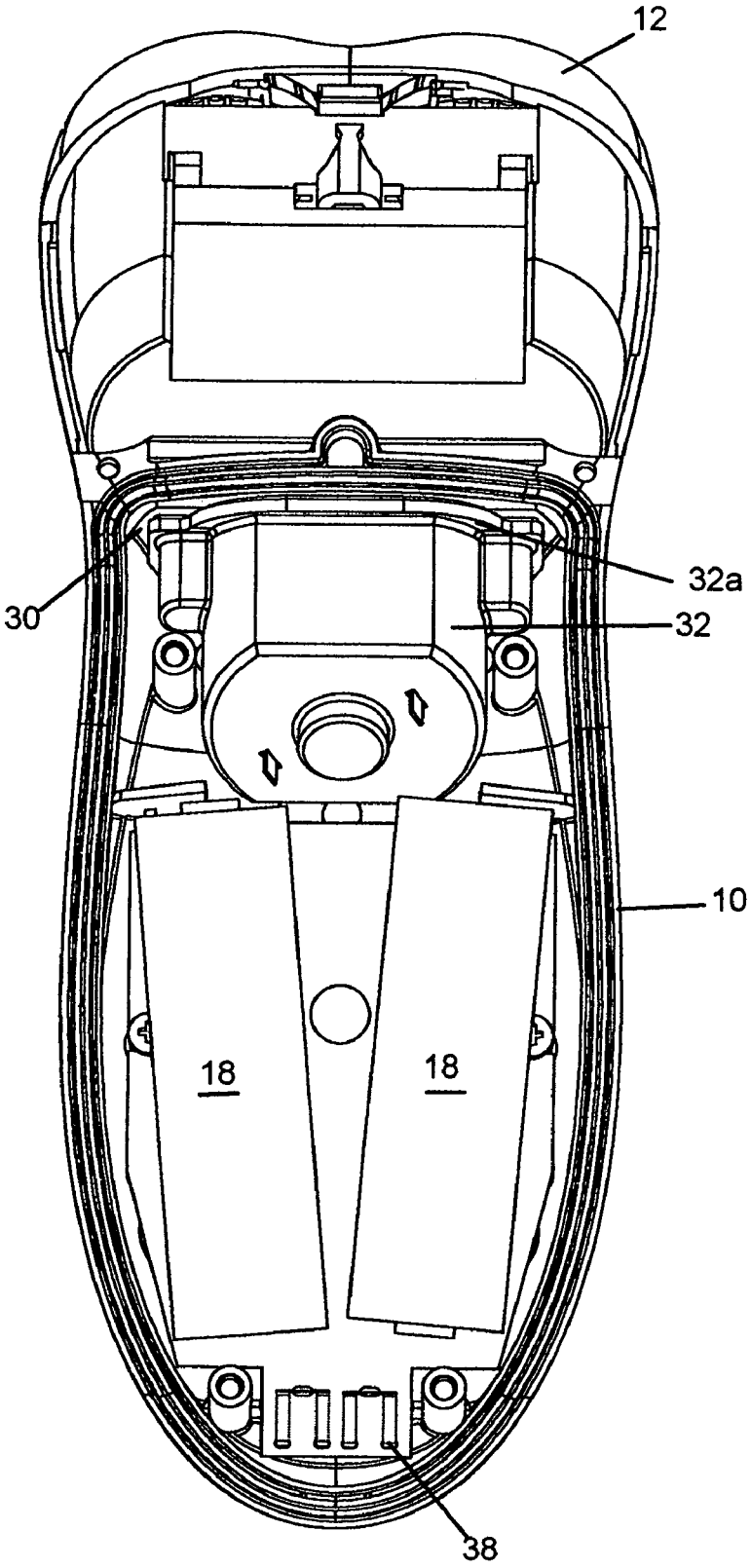
FIG. 5 is a rear view of the embodiment of FIG. 1.

FIG. 1 shows the internal structure of one embodiment of the rechargeable electric shaver of the present invention. This shaver is a waterproof, rotary type electric shaver. As shown in FIG. 1, the main body casing 10 of this electric shaver is formed in a curved shape.

In FIG. 1, the reference numeral 18 is a rechargeable battery which is installed in the lower portion of the main body casing 10, and 20 indicates a motor which is disposed in substantially the central portion of the main body casing. Since the main body casing 10 has a curved shape when seen from the side as seen from FIG. 1, the direction of length of the rechargeable battery 18 and the axial direction of the motor 20 are set at angles.

The shaver is provided with a partition wall 30 inside the main body casing 10, and this partition wall 30 is disposed in a position located on the shoulder of the motor 20. A motor cover 32 that accommodates the main body of the motor 20 is attached to the partition wall 30 in an airtight manner so that the motor cover 32 protrudes from the partition wall 30 into a rechargeable battery compartment A of the main body casing 10.

More specifically, the partition wall 30 is provided so that the interior of the main body casing 10 is partitioned into a rechargeable battery compartment A and a driving portion compartment B. The partition wall 30 is substantially parallel to the cutter cradle 50 that is installed in the uppermost portion of the main body casing 10, thus forming a space, in which a driving mechanism driven by the motor 20 is installed, between the partition wall 30 and the cutter cradle 50.

A motor mounting hole 30*a* which opens with a size that allows the main body of the motor 20 to be inserted (or to pass through) is formed in the central portion of the partition wall 30. A motor cover 32 which is a cylindrical casing with a closed bottom is attached to this motor mounting hole 30*a* so that the motor cover 32 protrudes toward or into the rechargeable battery compartment A. The motor cover 32 accommodates the main body of the motor 20; and it has a depth that allows the main body of the motor 20 to be received, and the internal diameter of the motor cover 32 matches the external diameter of the main body of the motor 20. In the shown embodiment, the motor cover 32 is formed with a depth that the shoulder of the motor 20 is outside when the motor 20 is in the motor cover 32.

The motor cover 32 not only accommodates the motor 20 but also separates the motor 20 in an airtight manner from the rechargeable battery compartment A. Accordingly, the motor cover 32 is formed using a material that can isolate the motor 20 in an airtight fashion. In the shown embodiment, the motor cover 32 is formed by being molded into a specified shape by resin molding using a synthetic resin. Rubber or the like can also be used instead of a synthetic resin.

In order to provide sealing for the rechargeable battery compartment A and driving portion compartment B in an airtight manner, a flange 32*a* is formed on the circumferential edge (on the side attached to the partition wall 30) of an opening of the motor cover 32, a sealing member 34 is provided between the partition wall 30 and the flange 32*a*, and the motor cover 32 is attached to the partition wall 30 so that the sealing member 34 is press-held by the flange 32*a* and partition wall 30.

The motor cover 32 and sealing member 34 act as a sealing means that separates the rechargeable battery compartment A and driving portion compartment B in an airtight manner. As a result, the driving portion compartment B in which the motor 20 is installed and the rechargeable battery compartment A in which the rechargeable battery 18 is installed form respective spaces that are separated in an airtight manner.

In a case that terminals are disposed on the bottom of the motor 20, connecting terminals used for the electrical connection of the motor 20 and rechargeable battery 18 are disposed in the bottom of the motor cover 32, and these connecting terminals are sealed in the motor cover 32 in an airtight manner by hermetic sealing or the connecting terminals that are provided so as to pass through the motor cover 32 are sealed in an airtight manner by means of a bonding agent, thus keeping the rechargeable battery compartment A and the driving portion compartment B separated in an airtight manner. It also possible to attach the connecting terminals to the partition wall 30 in an airtight manner and electrically connect the motor 20 and rechargeable battery 18 in a state in which the rechargeable battery compartment A and driving portion compartment B are separated in an airtight manner.

In the above structure, the partition wall 30 is disposed in the vicinity of the shoulder of the motor 20, the motor cover 32 is caused to extend from the partition wall 30 in a shape that conforms to the outer surface shape of the main body of the motor 20, and the motor 20 is disposed so that the main body of the motor 20 is inside the motor cover 32. Thus, in this structure, the motor cover 32 protrudes into the rechargeable battery compartment A. However, this is the most efficient structure for separating the interior space of the main body casing 10 by a partition wall, and a broad space can be ensured for the interior of the rechargeable battery compartment A. Since the rechargeable battery compartment A formed by the partitioning effect of the partition wall 30 constitutes a common space for the motor main body and battery, the degree of freedom of part arrangement is high in cases where circuits, etc. are disposed, and the electrical connections between parts are also facilitated.

In FIG. 1, terminals 38 used for charging are disposed in the bottom of the main body casing 10, and a ventilation hole is opened in the side surface of the bottom portion of the recess in which the charging terminals 38 are disposed, and a gas-permeable sheet 40 is provided so that this sheet closes off the ventilation hole. The gas-permeable sheet 40 allows the gas generated by the rechargeable battery 18 to be discharged to the outside of the main body casing 10.

A nickel-cadmium battery or the like is used for the rechargeable battery, and there may be instances in which a large amount of gas is generated inside the rechargeable battery by the charge-discharge reaction that takes place when reverse charging, etc. is performed. When the gas pressure inside the rechargeable battery rises, a safety valve (not shown) is actuated so that the gas from the rechargeable battery is discharged to the outside. The gas-permeable sheet 40 discharges such gas to the outside of the main body casing 10.

The electric shaver of the shown embodiment is a waterproof type electric shaver; and with the above-described gas-permeable sheet 40, the waterproof properties are ensured; and in addition, the gas released from the rechargeable battery 18 is discharged from the main body casing 10. In order to maintain the waterproof properties, a sealing member such as an O-ring or the like is disposed on the connecting portions, etc. of the main body casing 10. In this way, the rechargeable battery compartment A is designed so that the gas generated by the rechargeable battery 18 is discharged, and it is sealed off from the outside in a watertight manner and thus waterproofed.

Meanwhile, in regard to the waterproofing of the driving portion compartment B, a waterproof plate 52 is provided on the back surface side of the cutter cradle 50, i.e., on the driving portion compartment B side, and a sealing member 54 is disposed on the outer periphery of the waterproof plate 52. This sealing member 54 is press-held between the cutter cradle 50 and the waterproof plate 52, so that the driving portion compartment B is sealed in a watertight manner with respect to the cutter cradle 50.

A drive gear 23 is mounted on the drive shaft 22 of the motor 20, this drive gear 23 engages with a common gear 24, and this common gear 24 engages with rotation transmission gears 25 (only one gear 25 is shown) that respectively have rotary shafts 26 (only one shaft 26 is shown). The rotary shafts 26 fastened to the gears 25 are rotated when the rotation transmission gears 25 are rotated by the motor 20.

Engaging shafts 27 (only one shaft 27 is shown) are provided on the rotary shafts 26 so that the engaging shafts 27 are movable in the axial direction and are driven toward the outer cutters (thus in a float-supporting manner). Inner cutters (not shown in the drawings) are engaged with the engaging shafts 27, so that these inner cutters rotate together with the engaging shafts 27 when the engaging shafts 27 are rotationally driven by the rotary shafts 26. The inner cutters rotate while being caused to make constant sliding contact with the cutting surfaces of the outer cutters by the driving force of springs 29. As a result, a shaving action is performed.

The reference numeral 28 is a sealing member which seals (in a watertight manner) each of the rotary shafts 26 that protrude toward the cutter head 12 from the driving portion compartment B. The sealing member 28 is provided between the waterproof plate 52 and the outer circumferential surface of each rotary shaft 26 so as to make constant sliding contact with the outer circumferential surfaces of the rotary shafts 26, thus sealing the attached portions of the waterproof plate 52 and the rotary shafts 26 in the cutter cradle 50 in a watertight manner.

As seen from the above, a structure in which the driving portion compartment B surrounded by the cutter cradle 50, partition wall 30 and motor cover 32 is completely isolated from the outside is created, and the driving portion compartment B is sealed in a watertight manner. As a result, the driving portion compartment B is in a watertight manner, and the electric shaver as a whole (together with the rechargeable battery compartment A) is waterproofed.

Furthermore, since the driving portion compartment B and the rechargeable battery compartment A are partitioned in an airtight manner by the partition wall 30 and motor cover 32, the ignition of the gas inside the rechargeable battery compartment A by sparks from the motor 20 in the driving portion compartment B is prevented, so that the safety of the electric shaver is ensured.

In the shown embodiment, the motor 20 is supported by being fastened to a gear bearing plate 36 which is fastened to the main body casing 10. In regard to the method for installing the motor 20, the motor 20 can thus be supported on a supporting body (gear bearing plate 36) that is installed separately from the partition wall 30 or the motor 20 can be installed by being fastened to the partition wall 30.

In the above embodiment, a motor cover 32 is installed so that this motor cover 32 completely covers the outer surface of the main body of the motor 20 so as to protrude into the rechargeable battery compartment A. It is also possible to employ another structure in which a motor cover is disposed so that an airtight seal is formed between the inner circumferential surface of the motor mounting hole 30*a* formed in the partition wall 30 and the outer circumferential surface of the motor 20, so that the entire outer surface of the main body of the motor 20 that protrude into the rechargeable battery compartment A is not completely covered.

As seen from the above, in the rechargeable electric shaver of the present invention, a sealing means that separates the rechargeable battery compartment and driving portion compartment in an airtight manner is disposed on a partition wall that separates the rechargeable battery compartment and driving portion compartment, and the main body of the motor is set to protrude toward the rechargeable battery compartment side from this partition wall. Accordingly, the area in which the main body of the motor is disposed and the space in which the rechargeable battery is disposed are in a common space, so that the installation of parts inside the main body casing is facilitated, and the degree of freedom of various types of design increases.

The invention claimed is:

1. A rechargeable electric shaver comprising:

a main body casing, a rechargeable battery provided in said main body casing, a partition wall provided inside said main body casing, said partition wall defining a rechargeable battery compartment for said rechargeable battery and a driving portion compartment provided above said rechargeable battery compartment inside said main body casing and said partition wall is provided at a bottom of said driving portion compartment, a motor mounting hole provided in said partition wall, a motor provided in the driving portion compartment in said main body casing, and a motor cover attached to the partition wall in an airtight manner, the motor cover comprising a closed bottom and being configured to accommodate a portion of the motor, wherein the motor cover communicates with the motor mounting hole and both the closed bottom of the motor cover and the portion of the motor protrude into the battery compartment.

2. The rechargeable electric shaver according to claim 1, wherein:

a flange is provided on a circumferential edge of an opening of said motor cover, and a sealing member is provided between said partition wall and said flange, thus securing the airtightness between said motor cover and said partition wall.

3. The rechargeable electric shaver according to claim 1, wherein said electric shaver is a three cutting head rotary shaver wherein the three cutting beads are arranged in a triangle.

* * * * *